US007201373B2

(12) United States Patent
SanFelice

(10) Patent No.: US 7,201,373 B2
(45) Date of Patent: Apr. 10, 2007

(54) PINBALL TROUGH REPAIR SLEEVE AND METHOD

(76) Inventor: Anthony M. SanFelice, 3717 Sunset Ave., Williamstown, NJ (US) 08094

( * ) Notice: Subject to any disclaimer, the term of this patent is extended or adjusted under 35 U.S.C. 154(b) by 308 days.

(21) Appl. No.: 10/871,419

(22) Filed: Jun. 18, 2004

(65) Prior Publication Data

US 2005/0280207 A1 Dec. 22, 2005

(51) Int. Cl.
*A63F 7/22* (2006.01)
*A63F 7/36* (2006.01)

(52) U.S. Cl. ..... 273/118 R; 273/119 R; 273/121 D

(58) Field of Classification Search ..... 273/108, 273/118 R, 119 R, 121 R, 121 D; 473/132, 473/408; 428/122
See application file for complete search history.

(56) References Cited

U.S. PATENT DOCUMENTS 4,548,408 A * 10/1985 Clark ..... 273/121 A
4,797,600 A * 1/1989 Savage et al. ..... 318/254
5,358,243 A * 10/1994 Eddy et al. ..... 273/121 D
5,364,096 A * 11/1994 Cebula et al. ..... 273/121 A
5,497,989 A * 3/1996 Ritchie et al. ..... 273/118 R
5,529,299 A * 6/1996 Bellagamba ..... 473/285
6,022,280 A * 2/2000 Arenburg et al. ..... 473/408
6,290,617 B1 * 9/2001 Cole et al. ..... 473/408
2004/0142773 A1 * 7/2004 Kennedy ..... 473/408
2005/0280207 A1 * 12/2005 SanFelice ..... 273/118 R

* cited by examiner

*Primary Examiner*—Raleigh W. Chiu
(74) *Attorney, Agent, or Firm*—Stuart M. Goldstein

(57) ABSTRACT

A pinball repair sleeve for repairing the damage bottom surface of a pinball trough has a first section having a flat, smooth upper surface. Extending from the first section are two elongated arm components forming a V-configuration. The inward edges of the upper surfaces of the arm components are tapered down to facilitate the movement of pinballs down the arm components of the sleeve. The inward edges of the bottom surfaces of the arm components are tapered up to facilitate placement of the sleeve onto the corresponding V-shaped groove of the trough to be repaired. A resilient bracket hook member is provided beneath the first section to secure the sleeve to the trough.

35 Claims, 4 Drawing Sheets

PINBALL TROUGH REPAIR SLEEVE AND METHOD

BACKGROUND OF THE INVENTION

Over the years, pinball type games have and continue to be a popular yet challenging source of amusement and entertainment. The typical pinball machine includes a playfield which is downwardly inclined toward the player. The playfield consists of a number of play components, e.g. bumpers, ramps, flippers, guide rails, slots and targets. The player, positioned behind the lower end of the playfield, controls the game by operating flippers to direct pinballs at play components in order to score points. The pinballs travel around the playfield, affected by flippers, other play components and the force of gravity, which compels the pinballs down the inclined surface to the lower end of the playfield. Certain of the scoring targets have sensors, connected to circuitry which activates scoring displays. Play continues until the pinball traveling around the playfield is caused to exit the playfield by dropping into a hole, referred to as a drain hole, usually located behind flippers at the lower end of the playfield.

Having dropped into the drain hole, the pinball falls into a pinball trough, usually secured underneath the playfield surface, out of sight of the player. A most commonly used trough, one found in the design of thousands of pinball machines currently in operation, is the subject of U.S. Pat. No. 5,358,243. As seen in this patent, the trough is formed as a U-shaped channel, mounted beneath the playfield and extending between the drain hole and the shooter's lane, i.e. the point where the pinball is propelled back onto the playfield. The bottom surface of the trough is downwardly inclined and has a V-shaped groove. This configuration allows pinballs which drop through the drain hole to roll downward, along the groove, towards the shooter's lane. When the player pushes a button or otherwise activates a switch to bring a pinball which is within the trough onto the playfield, a solenoid plunger forces the pinball which is "on deck", that is nearest to the shooter's lane, up through an opening to the playfield.

Optical sensors mounted on the trough are positioned to detect the presence or absence of pinballs in the trough and, hence the movement of the machine's sensors which control the electronic play components on the playfield. If these sensors detect that pinballs are present in the trough and a pinball on deck which has yet to be sent for delivery to the playfield, the electronic play components will not be activated. If the sensors detect pinballs in the trough, but no pinball on deck, the system will presume there is a pinball in play (e.g. stuck on the playfield) and direct the game's electronic play components to operate. The game's electronics have a routine to begin a solenoid activation sequence (hunting), if a ball is missing and presumed still on the playfield. This will interrupt play and sometimes reset the game.

As the pinball troughs are usually made of a soft metal like tin, the constant impacting of the pinballs, which are made of a harder metal like chrome, on the troughs' bottom surfaces, causes these surfaces to become increasingly worn. Additionally, the pinballs themselves are subject to a number of abrasive forces, including the continual contact with the play components due to solenoid activation, contact with other pinballs, vibrations transmitted through the playfield surface and player agitation, and from wear caused by the pinballs being dropped onto the troughs. These forces cause abrasive surfaces on the pinballs. The pinballs, with their abrasive surfaces, resting on the bottom surfaces of the troughs, vibrate due to the agitation and movement of the pinball machines during routine play. This constant vibration results in the abrasive surfaces of the pinballs causing additional rutting and pitting and increased wear on the bottom surfaces of the troughs.

The pitting and wear which inevitably occurs on the bottom surface of the trough, in combination with the pitted pinballs, results in a pitted and uneven bottom surface. This encumbers the free movement of the pinballs as they roll down the inclined surface of the trough. In fact, the abrasively worn pinballs, once they fall from the drain hole onto the pitted trough, often have a tendency to roll to a stop within the trough, well short of the on deck location. Since, when this happens, there is no pinball in the on deck position, activation by the player who is calling for the delivery of a pinball onto the playfield will have no effect. This will usually result in the player pushing or attempting to tilt the pinball machine to move the pinball, which, at the very least disrupts the game and, at most, will damage the machine.

In addition, since the optical sensors mounted on the trough detect the presence of pinballs in the trough and no pinball on deck, the sensors and hence the system presume that there is a pinball in play and send signals to the electronic play components to continue to operate. As there is, in fact, no ball in play, the play components are needlessly being operated, causing undue wear and tear of these components.

There have been various attempts to address the problem of damaged pinball machine troughs. Most of these have centered around providing various types of shims to incline pinball machines with worn pinballs and troughs, thus further inclining troughs so that the pinballs are free to travel towards the shooter's lane. However, this has the obvious disadvantage of disrupting the calibrated operation of the machine, which is designed to operate with its components at a given degree to the horizontal. Replacement of the pinball trough is another option which has been considered; however, as the pinball machines using these troughs are no longer being manufactured, finding new pinball troughs is often an impossible task. Manufacturing a custom pinball trough is expensive and producing them in quantity would not be cost effective.

SUMMARY OF THE INVENTION

It is thus the object of the present invention to provide a means to address the problems resulting from worn pinball machine components by quickly, efficiently, and economically repairing pinball troughs which are damaged due to prolonged periods of usage.

It is an object of the present invention to provide a pinball repair sleeve which can be used to quickly and efficiently repair a pinball trough.

It is another object of the present invention to provide a pinball trough repair sleeve which can be easily and quickly inserted into existing pinball troughs to provide a smooth and unencumbered surface for the free flow of pinballs along the trough.

It is a further object of the present invention to provide a pinball trough repair sleeve which can be used on most all commonly used pinball troughs.

It is still another object of the present invention to provide a pinball trough repair sleeve which, once positioned in a pinball trough, will prevent the pitting and wear of pinball troughs for the remaining life of the pinball machine.

It is a further object of the present invention to provide a pinball trough repair sleeve which enhances the performance of the pinball machine by increasing the loading velocity of the pinballs down the trough.

It is another object of the present invention to provide a pinball trough repair sleeve which is unitary in construction and economical to manufacture.

It is a further object of the present invention to provide a method for repairing pinball troughs which can be accomplished simply, quickly, and economically.

These and other objects are accomplished by the present invention, a pinball trough repair sleeve consisting of a first section which has a flat, smooth upper surface. Extending from the first section are two elongated arm components forming a V-configuration. The inward edges of the upper surfaces of the arm components are tapered down to facilitate the movement of pinballs down the arm components of the sleeve. The inward edges of the bottom surfaces of the arm components are tapered up to facilitate placement of the sleeve onto the corresponding V-shaped groove of the trough to be repaired. A resilient bracket hook member is provided beneath the first section to secure the sleeve to the trough.

Novel features which are considered as characteristic of the invention are set forth in particular in the appended claims. The invention, itself, however, both as to its design, construction and use, together with the additional features and advantages thereof, are best understood upon review of the following detailed description with reference to the accompanying drawings.

DETAILED DESCRIPTION OF THE INVENTION

Figure 1:
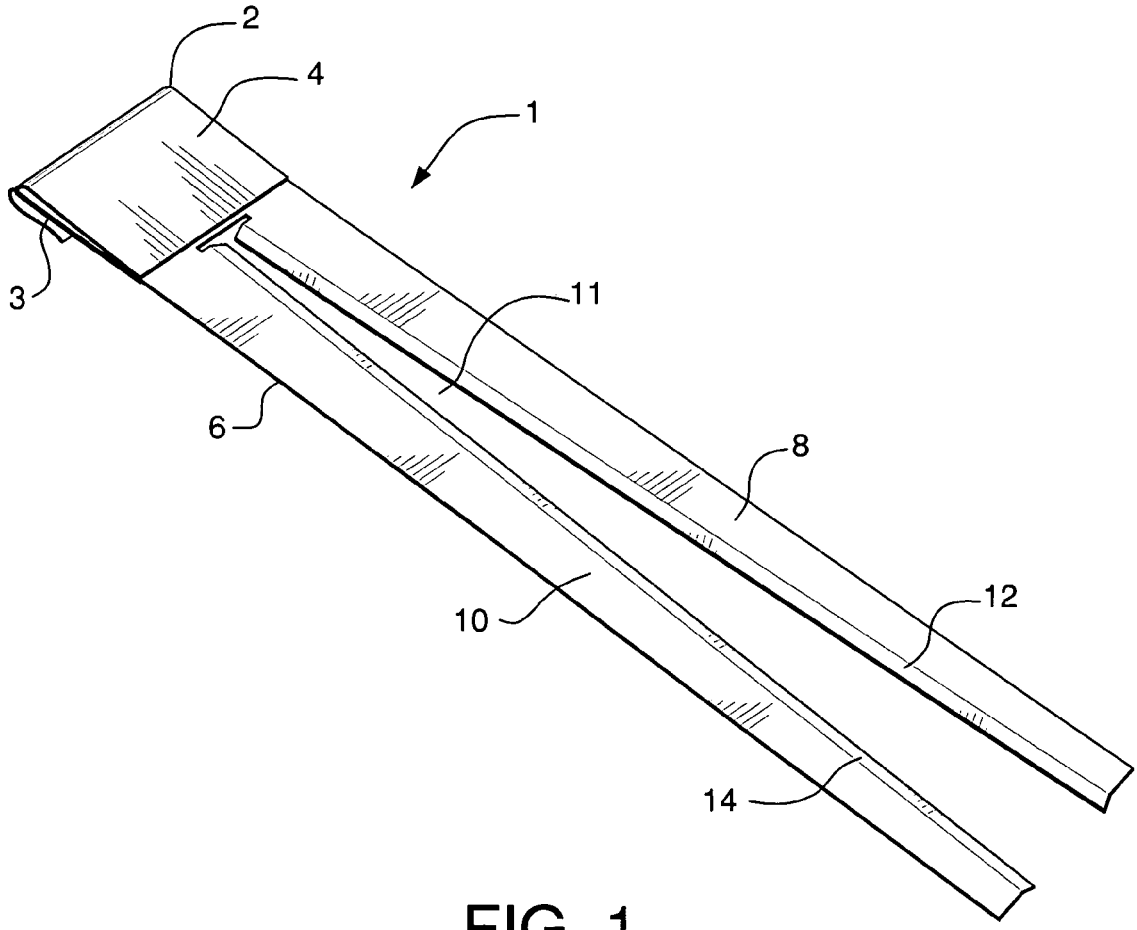
FIG. 1 is a perspective view of the repair sleeve of the present invention.
Figure 2:
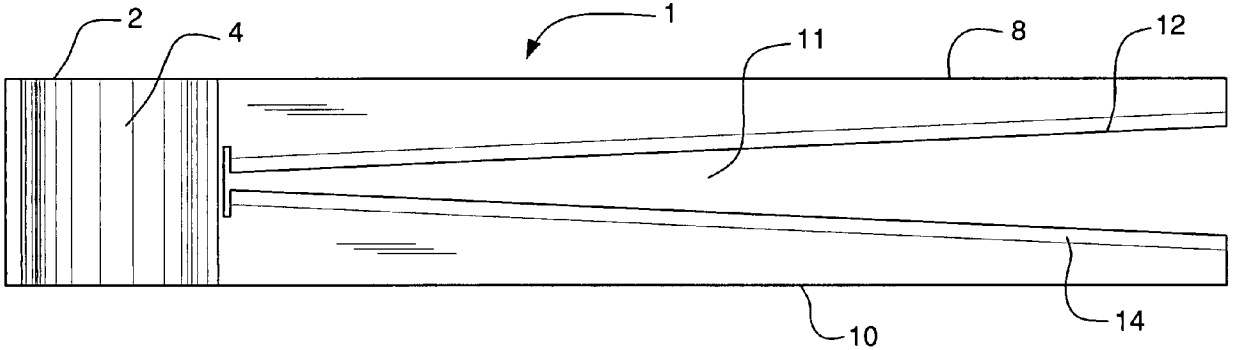
FIG. 2 is a top view of the repair sleeve of the present invention.
Figure 3:
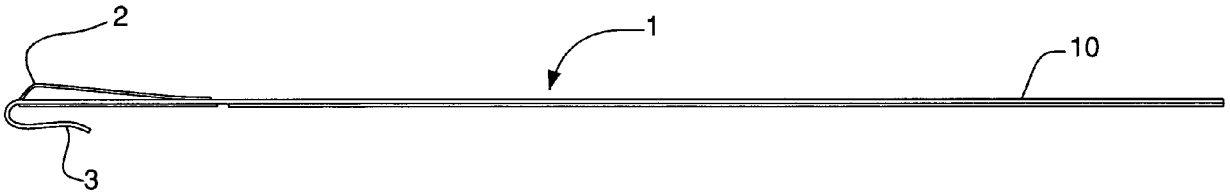
FIG. 3 is an elevation view of the repair sleeve of the present invention.
Figure 4:
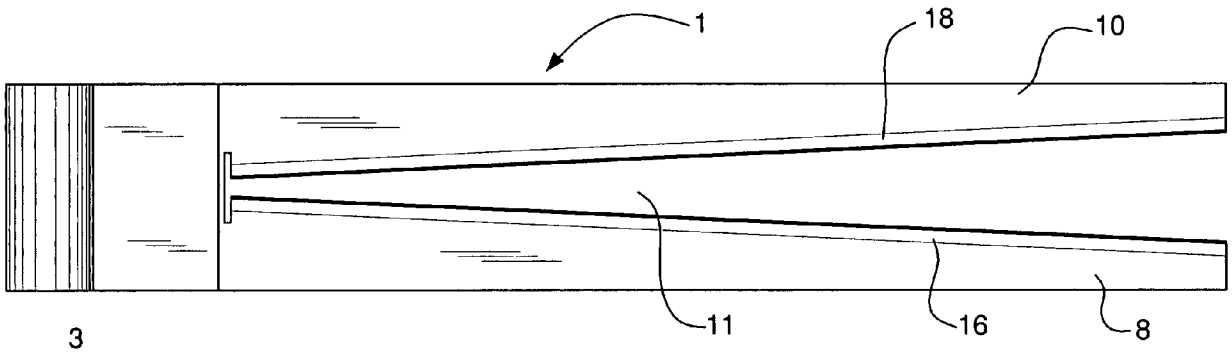
FIG. 4 is a bottom view of the repair sleeve of the present invention.

Pinball trough repair sleeve 1 is a unitary body which comprises elevated, angled ramp section 2, with smooth, flat upper surface 4. Resilient bracket hook member 3 extends from ramp section 2 around to the underside of sleeve 1. Section 6 extends from ramp section 2 and comprises elongated arm components 8 and 10 which form V-shaped opening 11. Inboard edge 12 on the upper surface of arm component 8 and inboard edge 14 on the upper surface of arm component 10 are downwardly taped. Inboard edge 16 on the bottom surface of arm component 8 and inboard edge 18 on the bottom surface of arm component 10 are upwardly taped.

Figure 5:
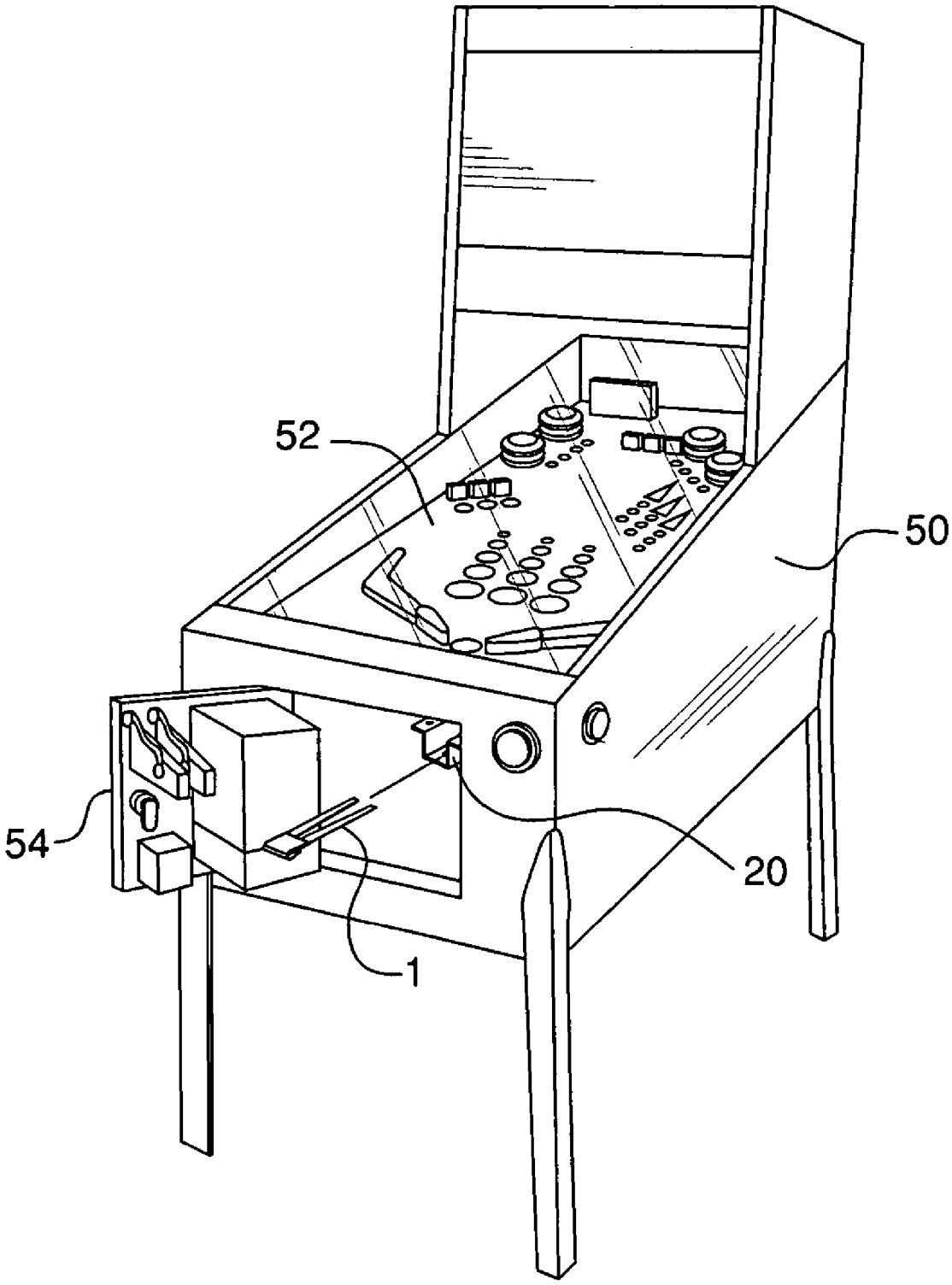
FIG. 5 shows the positioning of the repair sleeve of the present invention in relation to the pinball machine and pinball trough to be repaired.
Figure 6:
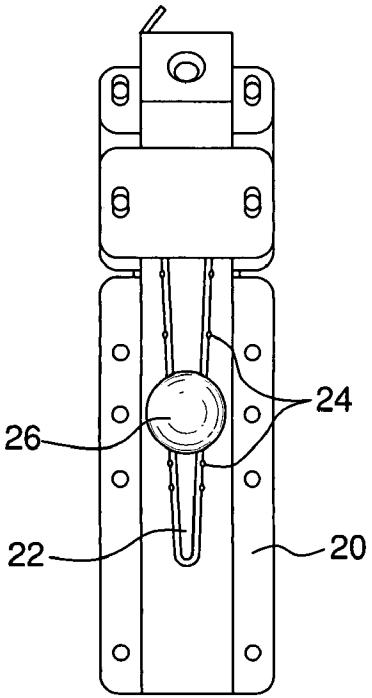
FIG. 6 is a top view of a damaged pinball trough in use with a pinball.

FIG. 5 shows how sleeve 1 will be placed in relation to pinball machine 50, to repair pinball trough 20. Trough 20, with V-shaped groove 22 shown in FIG. 6, has rutting or pitting damage 24. This damage will inhibit or totally prevent the downward movement of pinball 26 along groove 22 of the trough, toward the shooter's lane, where the pinball would be sent into play onto playfield 52 of pinball machine 50.

Figure 7:
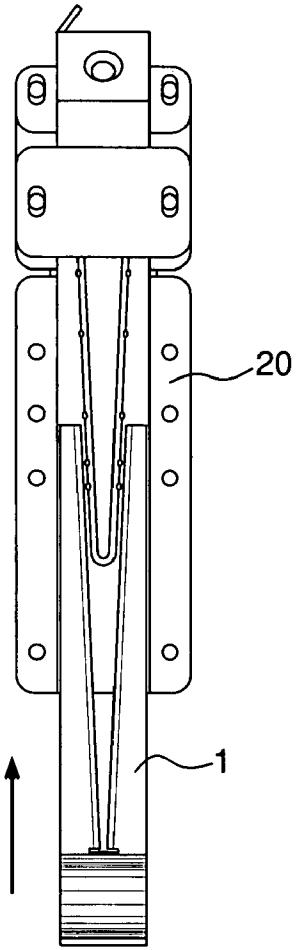
FIG. 7 depicts an in progress repair of a pinball trough by the repair sleeve of the present invention.

The repair of trough 20 is accomplished by simply opening door 54 of pinball machine 50. Sleeve 1 is positioned adjacent to and then inserted, with bracket hook 3 faced downward, into trough 20. See FIG. 7. Sleeve 1 is then slid completely into trough 20, such that V-shaped opening 11 of the sleeve is directly over V-shaped groove 22. As sleeve 1 is slid all the way into trough 22, the resilient nature of bracket hook 3 allows it to expand outward and close onto the bottom surface of the trough, thus securing the sleeve within the trough. Door 54 is then closed and secured. The repair is simply and quickly completed.

Figure 8:
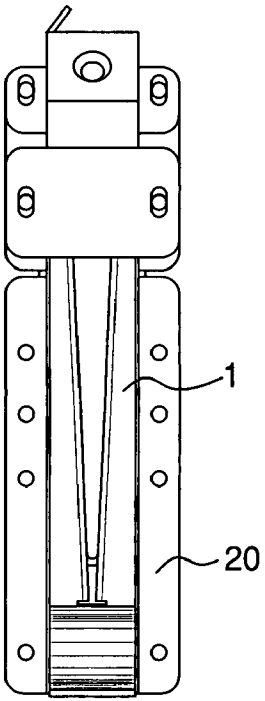
FIG. 8 depicts the repair sleeve of the present invention in place within the repaired pinball trough.

As shown in FIG. 8, sleeve 1 has addressed the wear damage on the bottom surface of trough 20 by covering the pitting on the surface. This results in a virtually new unpitted and smooth trough bottom surface, compliments of sleeve 1. Upwardly tapered edges 16 and 18 of arm components 8 and 10 respectively, assist in maintaining V-shaped opening 11 of the sleeve 1 over V-shaped groove 22 of the trough. Downwardly tapered edges 12 and 14 of arm components 8 and 10 respectively, facilitate the rolling movement of pinballs downwardly through trough 20.

Upon insertion of sleeve 1 into trough 20 and completion of the repair, pinballs will then drop through the drain hole of pinball machine 50, onto surface 4 of ramp section 2 of sleeve 1. Whether pitted or not, the pinballs can then smoothly roll, unencumbered and uninterrupted along arm components 8 and 10, downwardly to the on deck position adjacent to the shooter's lane. The movement of the pinballs will never again be inhibited nor will they be caused to stop, due to trough or pinball damage.

As described previously and shown in the drawings, ramp section 2 is elevated and angled downward towards section 6. This configuration is an important part of the repair accomplished by sleeve 1, in that the ball feed performance of the trough is significantly increased. As the pinball drops onto surface 4 of ramp section 2, the ramp acts to accelerate the loading velocity of the pinball down the trough. This ensures proper pinball positioning, preventing optic sensor errors.

It is anticipated that sleeve 1 will be manufactured of stainless steel. This material will withstand the constant impact and movement of the pinballs along the surfaces of sleeve 1 without sustaining any damage. In other words, once the repair is effected, it will never need to be done again.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A sleeve for the repair of a pinball trough, said sleeve being a unitary body having a given length and comprising:

(a) first section means for receiving pinballs onto the sleeve; and (b) elongated second section means extending from the first section means for allowing substantially unencumbered movement of pinballs from the first section means along substantially the full length of the sleeve, said second section comprising elongated arm components with tapered edges, said tapered edges comprising upper and lower surfaces, the upper surfaces being tapered down and the lower surfaces being tapered up.

2. The sleeve as in claim 1 further comprising means to secure the sleeve to a pinball trough.

3. The sleeve as in claim 2 wherein the means to secure the trough comprises a resilient bracket hook.

4. The sleeve as in claim 1 wherein the first section means is angled downward towards the second section means.

5. The sleeve as in claim 1 wherein the second section means forms a V-shaped opening.

6. The sleeve as in claim 5 wherein the V-shaped opening corresponds to a V-shaped groove in a pinball trough.

7. A sleeve for the repair of a pinball trough, said sleeve being a unitary body comprising a first section with a substantially flat upper surface, said first section being located at one end of the sleeve, and a second section comprising two elongated arm components extending from the first section, the arm components forming a V-shaped opening therebetween and having tapered edges, said tapered edges comprising upper and lower surfaces, the upper surfaces being tapered down and the lower surfaces being tapered up.

8. The sleeve as in claim 7 further comprising means to secure the sleeve to a pinball trough.

9. The sleeve as in claim 8 wherein the means to secure the trough comprises a resilient bracket hook.

10. The sleeve as in claim 7 wherein the first section means is angled downward towards the second section means.

11. The sleeve as in claim 7 wherein the V-shaped opening corresponds to a V-shaped groove in a pinball trough.

12. The repair sleeve as in claim 7 wherein the first section comprises a resilient bracket hook.

13. A pinball trough comprising a substantially U-shaped channel and an inclined bottom surface with an elongated V-shaped groove, said trough further comprising a sleeve positioned on the bottom surface, said sleeve having a first section with a substantially flat upper surface and a second section comprising two elongated arm components extending from the first section, said arms forming a V-shaped opening substantially corresponding to the V-shaped groove.

14. The pinball rough as in claim 13 further comprising means to secure the sleeve to the trough.

15. The pinball trough as in claim 14 wherein the means to secure the trough comprises a resilient bracket hook.

16. The pinball trough as in claim 13 wherein the first section is angled downward towards the second section.

17. The pinball trough as in claim 13 wherein the arm components comprise tapered edges.

18. The pinball trough as in claim 13 in which the tapered edges comprise upper and lower surfaces, the upper surfaces being tapered down and the lower surfaces being tapered up.

19. A pinball trough with a substantially U-shaped channel and an inclined bottom surface with an elongated V-shaped groove, said trough further comprising a sleeve having a given length positioned on the bottom surface, said sleeve comprising first section means for receiving pinballs onto the sleeve and elongated second section means extending from the first section means for allowing substantially unencumbered movement of pinballs from the first section means along substantially the full length of the sleeve.

20. The pinball trough as in claim 19 further comprising means to secure the sleeve to the trough.

21. The pinball trough as in claim 20 wherein the means to secure the trough comprises a resilient bracket hook.

22. The pinball trough as in claim 19 wherein the first section means is angled downward towards the second section means.

23. The pinball trough as in claim 19 wherein the second section means comprises elongated arm components.

24. The pinball trough as in claim 23 wherein the arm components comprise tapered edges.

25. The pinball trough as in claim 24 in which the tapered edges comprise upper and lower surfaces, the upper surfaces being tapered down and the lower surfaces being tapered up.

26. The pinball trough as in claim 23 wherein the arm components form a V-shaped opening.

27. The pinball trough as in claim 26 wherein the V-shaped opening corresponds to the V-shaped groove.

28. The pinball trough as in claim 19 wherein the second section means forms a V-shaped opening.

29. The pinball trough as in claim 28 wherein the V-shaped opening corresponds to the V-shaped groove.

30. A method for repairing a pinball trough with a substantially U-shaped channel, an open end, and an inclined bottom surface with an elongated V-shaped groove, said method comprising the steps of:

(a) providing a unitary sleeve with a first section comprising a substantially flat upper surface and a second section comprising two elongated arm components extending from the first section;

(b) positioning the elongated arm components of the sleeve adjacent to the open end of the channel of the trough;

(c) inserting the elongated arm components of the sleeve into the channel such that the V-shaped opening of the sleeve overlays the V-shaped groove of the trough.

31. The method as in claim 30 wherein the channel comprises a door which closes off the open end of the channel, said method further comprising the step of opening the door before positioning the elongated arm components of the sleeve adjacent to the open, end of the channel.

32. The method as in claim 31 further comprising the further step of closing and securing the door.

33. The method as in claim 31 comprising the further step of securing the sleeve to the trough.

34. The method as in claim 33 comprising the further step of closing and securing the door.

35. The method as in claim 30 comprising the further step of securing the sleeve to the trough.

* * * * *